US005774853A

United States Patent [19]

Lin

[11] Patent Number: 5,774,853

[45] Date of Patent: Jun. 30, 1998

[54] SERIAL INTERFACE SPEECH SYNTHESIZERS

[75] Inventor: James Lin, Hsin Chu, Taiwan

[73] Assignee: Winbond Electronics Corporation, Hsinchu, Taiwan

[21] Appl. No.: 874,442

[22] Filed: Jun. 16, 1997

Related U.S. Application Data

[63] Continuation of Ser. No. 179,745, Jan. 11, 1994, abandoned.

[51] Int. Cl.[6] ..... G10L 3/00

[52] U.S. Cl. ..... 704/258

[58] Field of Search ..... 395/2.67

[56] References Cited

U.S. PATENT DOCUMENTS 4,264,783 4/1981 Gagnon ..... 395/2.7

4,412,099 10/1983 Niyada et al. ..... 395/2.67

4,423,290 12/1983 Yoshida et al. ..... 381/51

4,489,438 12/1984 Hughes ..... 381/51

*Primary Examiner*—Allen R. MacDonald

*Assistant Examiner*—Vijay B. Chawan

*Attorney, Agent, or Firm*—Meltzer, Lippe, Goldstein, Wolf & Schlissel, P.C.

[57] ABSTRACT

Speech synthesizer systems avoid the need for a multi-path address bus coupling to a CPU by provision of serial interfaces requiring a total of only two or three signal paths to a CPU. By use of a counter circuit or shift register working in cooperation with a modified trigger signal circuit, a serially encoded control signal is internally converted to binary type signals which are coupled via an internal address bus to a speech synthesis unit for production of selected speech segment output signals.

5 Claims, 2 Drawing Sheets

SERIAL INTERFACE SPEECH SYNTHESIZERS

This is a continuation of application Ser. No. 08/179,745, filed Jan. 11, 1994 now abandoned.

This invention relates to the control of speech synthesizers and, more particularly, to the simplification of interface requirements between a speech synthesizer and a control unit.

BACKGROUND OF THE INVENTION

Speech synthesizer equipment is being utilized in an increasing number and variety of applications. A basic synthesis unit for use in such equipment may be capable of providing a complement of 256 speech segments under the control of a central processing unit ("CPU") or microcontroller. The speech segments may be selected in various serial combinations in order to simulate spoken words when coupled to a transducer, such as an audio speaker. In a typical prior art arrangement, as shown in FIG. 1, a synthesizer system includes a speech synthesizer 10 controlled by CPU 12 via an address bus 14 and certain additional signal paths. In order to permit selection of any one of 256 different speech segments, prior systems have required inclusion of an address bus 14 including eight parallel signal paths coupled from CPU 12 to the synthesizer 10.

In operation of the FIG. 1 system, signals representative of speech to be synthesized are provided to the CPU at input terminal 16. In response, the CPU 12 provides speech segment selection signals to synthesizer 10, via the multiconductor address bus 14, and trigger signals, via an input terminal 18. Within synthesizer 10, synthesis unit 20 responds to both the selection signals from the CPU and trigger signals coupled via trigger unit 22. Trigger unit 22, which is commonly referred to as a debounce circuit, is effective to provide a filtering function to process the input trigger signals to reduce spurious or false triggering effects, in order to improve the capability of providing recognizable simulated speech outputs. Thus, synthesis unit 20 is activated by the trigger signals to produce desired speech segment signals, as selected by selection signals coupled via address bus 14. The synthesized speech is produced at the speaker 21. Synthesis unit 20 is arranged to couple a "busy" signal to CPU 12, via output terminal 24, to indicate its operating status (i.e., to indicate whether unit 20 is ready to receive further selection signals and be activated by a trigger signal).

With reference to FIG. 2, there are-shown in simplified form certain signal relationships involved in operation of a FIG. 1 type prior art system. As shown, (A) represents selection signals provided from the CPU 12 to synthesizer 10 via the eight path address bus 14. Signal (B) represents trigger signals provided via input terminal 18. Signal (C) represents a busy signal coupled back to CPU 12 to indicate the operating status of the synthesizer unit. As illustrated, during the positive portions of the busy signal (C) speech segments (sounds 1, 2 and 3) as identified by the address signal (A) are being fed to a speaker. At (E) there is represented a spurious signal or noise spike appearing undesirably in the trigger signal. As noted, trigger unit 22 is effective to process signal (B) to remove the effects of spurious signals, such as represented at (E), by a filtering process which discriminates against signals of short time duration. Such spurious signals will thereby be deleted from the trigger signals coupled from trigger unit 22 to synthesis unit 20.

It will thus be seen that prior implementation of a speech synthesizer system using synthesis unit 20 has necessitated the cost and complexity of a ten path interface between the control unit 12 and the synthesizer 10. In practice, the ten paths (terminals 18 and 24 and eight path bus 14) may take the form of pins associated with implementation of integrated circuitry, rather than separate terminals as illustrated. There is also an eleventh pin for the speaker 21. Regardless of the actual form however, the requirement to provide ten CPU signal paths in application of the speech synthesizer represents an undesirable cost and complexity.

It is therefore an object of the present invention to simplify the interface between a CPU and a speech synthesizer and, more particularly, to provide such an interface requiring only a total of two or three signal paths.

Additional objects are to provide new and improved synthesizer systems utilizing simplified serial interfaces between a speech synthesizer and a control unit.

SUMMARY OF THE INVENTION

In accordance with the invention, a serial interface speech synthesizer system includes a synthesis unit, responsive to a trigger signal. The synthesis unit provides any one of $2^N$ speech segment signals as selected by selection signals coupled via an address bus having at least N signal paths. The synthesis unit also provides a status signal indicative of its operating state. A counter coupled to the synthesis unit provides selection signals to the synthesis unit, via the address bus, in response to a control signal received via an input port having only a single signal path. A trigger signal unit, coupled to the synthesis unit and responsive to such control signal, processes the control signal to reduce undesired triggering effects in order to provide a trigger signal for the synthesis unit. The trigger unit also provides a reset signal for the counter, with the reset signal having a predetermined timing relation to the trigger signal. A control unit, or CPU, provides the control signal to the input port of the counter via the single signal path in a form serially encoded to include information on selection of the desired speech segment signals. The control unit or CPU is responsive to the status signal generated by the synthesizer unit. The control signals are provided with a predetermined timing relative to the operating state of the synthesis unit. The system also includes an output port for coupling speech segment signals from the synthesis unit to a utilization device such as a speaker. Thus, with use of the invention, only two signal paths are required for control of the synthesizer: one path is for transmission of the control signal from the CPU to the counter, the second path is for transmission of status information from the synthesis unit to the CPU.

In a particular embodiment, the speech synthesizer is arranged to provide any one of 256 speech segment signals, the address bus internal to the synthesizer includes at least eight signal paths, and the output port is arranged to couple the speech segment signal to a utilization device in the form of a speaker effective to provide a sound output wherein different speech segment signals are combined in series to simulate spoken words. Aside from the speaker connection, the serial interface arrangement using the invention accomplishes this operation while reducing the CPU interface from ten to only two signal paths.

For a better understanding of the invention, together with other and further objects reference is made to the following description taken in connection with the accompanying drawings and the scope will be pointed out in the appended claims.

DESCRIPTION OF THE INVENTION

Figure 1:
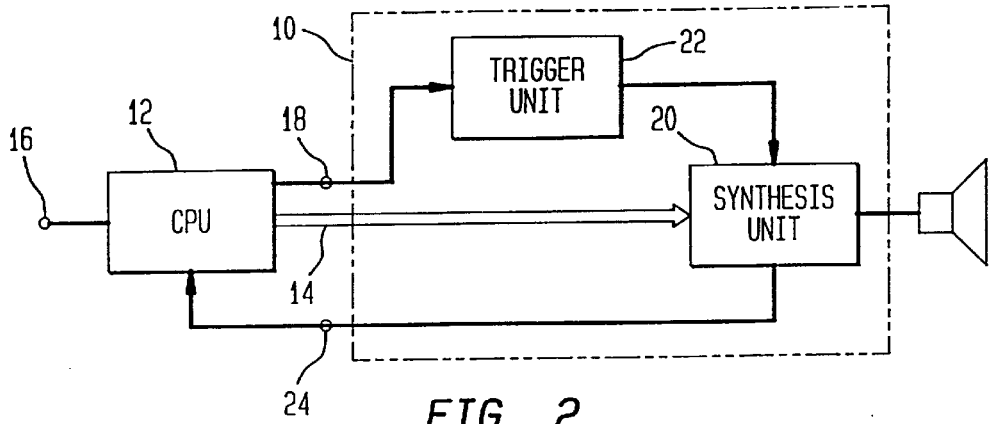
FIG. 1 (PRIOR ART)
FIG. 1 is a block diagram of a prior art parallel interface speech synthesizer system.
Figure 2:
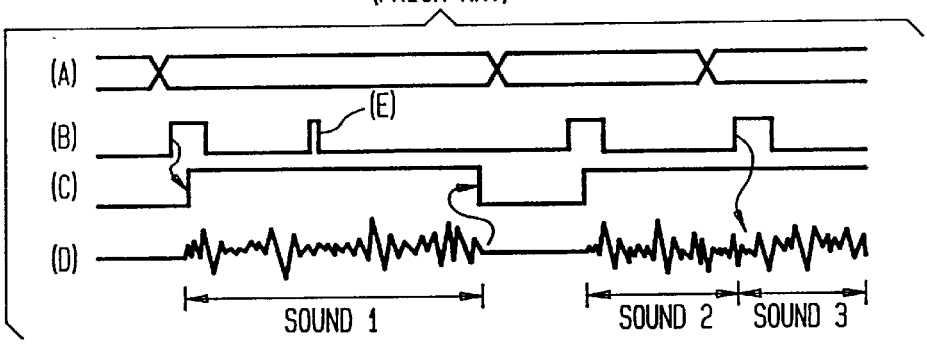
FIG. 2 (PRIOR ART)
FIG. 2 shows relationships between signal waveforms involved in operation of the FIG. 1 system.
Figure 3:
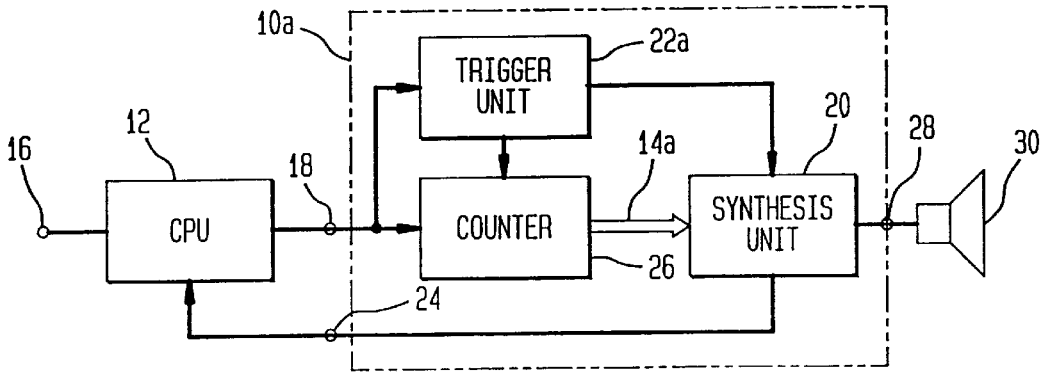
FIG. 3 is a block diagram of a first embodiment of a serial interface speech synthesizer system utilizing the present invention.

Referring now to FIG. 3, there is shown a first embodiment of a serial interface speech synthesizer system which, in accordance with the invention, requires only two signal paths between CPU 12 and synthesizer 10*a*. As illustrated, synthesis unit 20 is responsive to a trigger signal provided by trigger unit 22*a*. Synthesis unit 20 is arranged for providing any one of a variety of speech segment signals (e.g., any one of $2^N$, or 256 speech segment signals, in the case where N equals 8). The particular speech segment is selected by selection signals coupled via an address bus 14*a* having several (e.g., eight) parallel signal paths. As shown in FIG. 3, address bus 14*a* is internal to synthesizer 10*a* and does not require connection to the CPU 12. Synthesis unit 20 provides a status signal indicative of its operating state to the CPU 12, via pin or terminal 24, for use as a "busy" signal.

The FIG. 3 system also includes signal conversion means, shown as counter 26. Counter 26 is arranged for converting a control signal (coupled via input port or terminal 18, having only a single signal path) to a selection signal in parallel form coupled to synthesis unit 20 via the parallel signal paths of the address bus 14*a*. As shown, counter 26 provides the selection signal in parallel form in response to serially encoded control signals. The serially encoded signal at port 18 may, for example, comprise a series of pulses configured to provide a numerical representation of the desired speech segment. Thus, while selection signals are arranged to be coupled to synthesis unit 20 over an eight path address bus which is internal to the synthesizer 10*a*, only a single signal path is required for coupling the control signal from the CPU to synthesizer 10*a* via port 18.

The trigger unit 22*a* of FIG. 3 is arranged for processing the control signal supplied via port 18 to reduce undesired triggering effects in trigger signals coupled to synthesis unit 20, and also to provide a reset signal coupled to counter 26. The reset signal has a predetermined timing relation to the trigger signals and is effective to reset counter 26 so that it is ready to provide additional selection signals to synthesis unit 20 in response to further control signals received from CPU 12.

Control means are provided in the FIG. 3 embodiment in the form of CPU 12. In response to signals representative of synthesized speech to be produced, as received via terminal 16, CPU 12 is arranged to use known coding techniques in order to provide the serially encoded control signals already discussed. As shown, CPU 12 is also responsive to status signals coupled from synthesis unit 20 via the second signal path including signal port 24. These status signals are indicative of the operating state of synthesis unit 20 and can be used by CPU 12 to determine whether unit 20 is busy or is ready for timely production of further selection signals identifying the next speech segment signal to be produced. The CPU is thus enabled to provide the control signals in a predetermined time relationship to the operating state of the synthesis unit 20. The FIG. 3 speech synthesizer system 10*a* further includes an output port 28 for coupling speech segment signals to a utilization device such as audio speaker 30.

Figure 4:
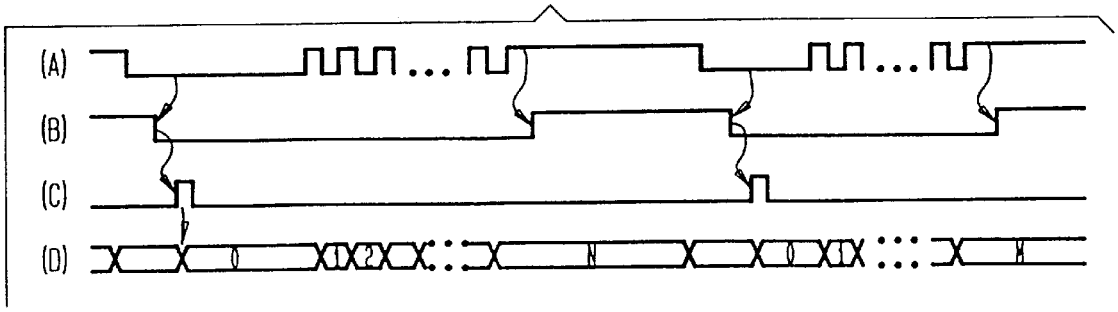
FIG. 4 illustrates certain signal relationships relevant to operation of the FIG. 3 system.

Referring now to FIG. 4, there are shown in simplified form certain signal relationships relating to operation of the speech synthesizer system of FIG. 3. As shown, (A) represents the control signals provided by CPU 12 to single path port 18 and effectively comprises a step function signal with a series of pulses superimposed to provide serially encoded information on selection of desired speech signal segments. Signal (B) represents the trigger signals provided by trigger unit 22*a* in response to the control signal. As shown, the debounce or filtering type processing in trigger unit 22*a* is arranged to make it non-responsive to the short duration changes represented by the pulse signal encoding. Signal (C) illustrates reset signals generated by trigger unit 22*a* with predetermined timing relative to falling edges of the trigger signal (B). Signal (D) illustrates the response of counter unit 26 to the reset signal (C). As indicated, counter unit 26 begins counting in response to the reset signal and continues counting for the duration of the series of pulses included in signal (A). Thus, the counting function continues until the count has reached the number representing the speech signal segment whose selection is desired. Signal (E) represents the status signal coupled back to CPU 12 via port 24, with the positive signal portions representing periods during which synthesis unit 20 is busy producing selected speech segment output signals.

Considering operation of the FIG. 3 system, it will be seen that trigger unit 22*a* is arranged to be non-responsive to the pulse signals representing serially encoded speech segment selection information. Ignoring such pulse signals, a falling edge trigger signal generates a reset signal which resets the counter to zero. The counter 26 then responds to the pulses included in the control signal received from the CPU. For example, after N pulses, the counter will have correspondingly counted to N and the number N is sent to synthesis unit 20 in binary form via the address bus 14*a*. With the rising edge of the trigger signal the synthesis unit 20 is activated to output the speech segment represented by the number N and at the same time a busy signal will be coupled back to CPU 12. A subsequent falling edge of the trigger signal is effective to result in another reset signal which resets the counter 26 so that it is ready to count pulses representative of the next selected speech segment to be produced. The selected speech segments produced by synthesis unit 20 are converted into simulated speech by speaker 30. In this manner, the invention enables control of synthesizer 10*a* by CPU 12, while requiring only two signal paths connecting these two units.

Figure 5A:
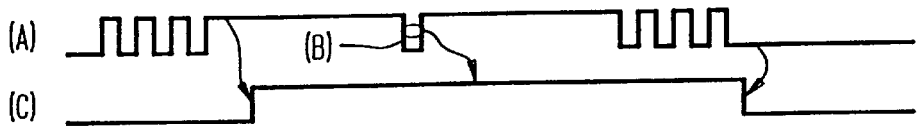
FIGS. 5A and 5B show signal relationships relevant to operation of trigger units of types usable in application of the invention.
Figure 5B:
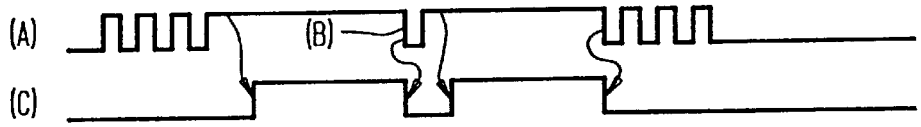

With reference now to FIG. 5A, the operation of trigger unit 22*a* will be briefly considered. Unit 22*a* is arranged to provide a filtering effect with respect to both rising edges and falling edges of the control signal provided at input port 18. As already discussed, trigger unit 22*a* is non-responsive to coding pulses included in the control signal as a result of the filtering effect which also discriminates against spurious pulses or noise spikes. Signal (A) as shown FIG. 5A represents a control signal including coding pulses and an isolated spurious pulse (B). Signal (C) represents the resulting trigger signal and it will be seen that with filtering effective for both rising and falling edges, the trigger signal output is not responsive to the spurious pulse (B). Specifically, in FIG. 5A, signal (C) goes high, if signal (A) remains high for a predetermined time period and signal (C) goes low if signal (A) remains low for a predetermined period of time. FIG. 5A is representative of the operation of trigger unit 22*a* as included in the FIG. 3 system. FIG. 5B relates to a different form of trigger unit, which is arranged to provide a filtering effect only with respect to the rising edge of a control signal. Either form of trigger unit can be provided by persons skilled in this field. In FIG. 5B, signal (A) is the same as signal (A) in FIG. 5A, including the presence of spurious pulse (B). However, in signal (C) of FIG. 5B it will be seen that the trigger signal reflects falling edges exclusive of any filtering effect, while rising edges are processed in the same manner as was illustrated in FIG. 5A. In FIG. 5B, signal (C) goes low immediately when signal (A) goes low, but signal (C) goes high only when signal (A) goes high for a predetermined period of time.

Figure 6:
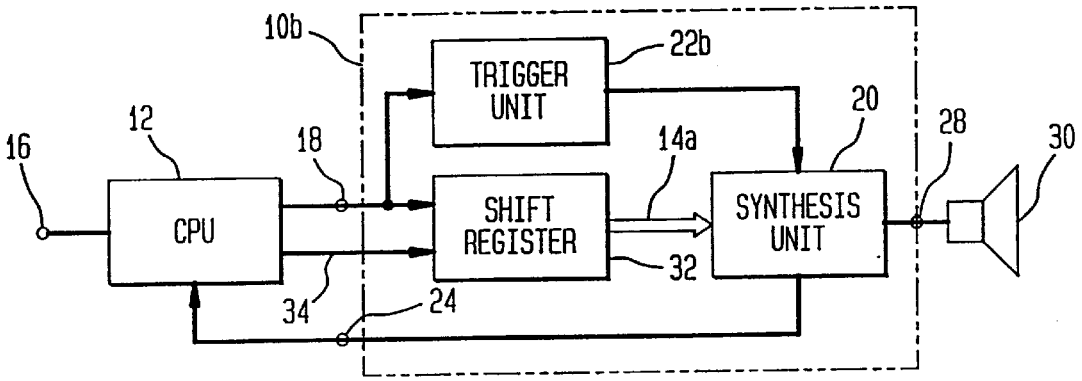
FIG. 6 is a block diagram of a second embodiment of a speech synthesizer system using the invention.

FIG. 6 illustrates a second embodiment of a serial interface speech synthesizer system in accordance with the invention. While the FIG. 6 system is generally similar to the FIG. 4 system, there are three basic differences. Trigger unit 22*b* is arranged to provide a filtering effect only with respect to the rising edge of a control signal, as described with reference to FIG. 5B. Counter 26 of FIG. 5 is replaced by shift register 32. Also, a third input signal path is added to permit a clock signal to be supplied to shift register 32 for timing control purposes, via single path port 34. As illustrated, the clock signal input is supplied to port 34 from CPU 12, however it may be desirable to provide a separate clock signal source connected to port 34. With the FIG. 6 arrangement, it is possible to achieve an increase in the speed of the speech segment selection process.

Figure 7:
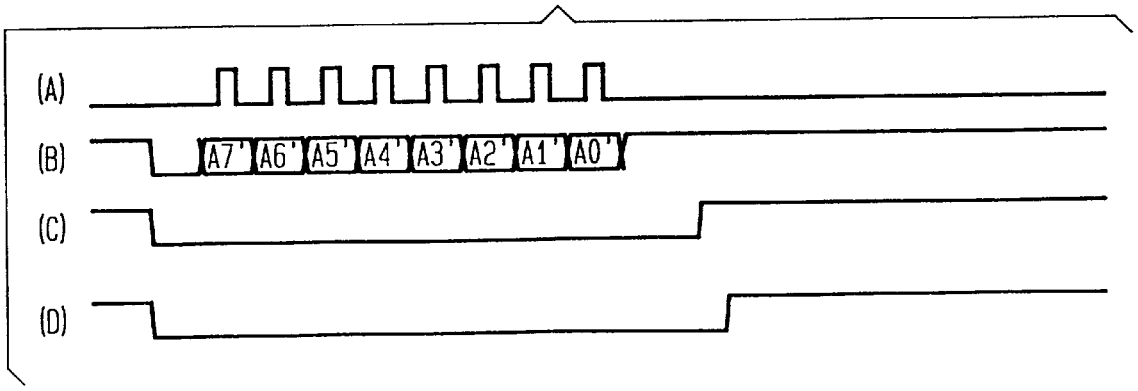
FIG. 7 illustrates certain signal relationships relevant to operation of the FIG. 6 system.

FIG. 7 shows in simplified form certain signal relationships relevant to operation of the FIG. 6 speech synthesizer system. The clock signals input at port 34 comprise a series of pulses as illustrated at (A). At (B) is represented the result of shift register 32 operating in response to the clock pulses and the control signal input at port 18 to provide binary type speech segment selection signals which are coupled to synthesis unit 20 via the address bus 14*a*. Specifically, the shift register 32 keeps track of the number of clock pulses received until the control signal is generated. This number is then ouputted in parallel form on the bus 14*a* to address the synthesis unit 20. Thus, the shift register 32 acts as a serial-to-parallel converter. Signal (C) shows the trigger signal coupled to the synthesis unit 20 from trigger unit 22*b*. Here the trigger unit provides a filtering effect only on the rising edges included in the control signal from CPU 12 and the circuit arrangement including the shift register provides a level of immunity from spurious pulses passing through the trigger unit. Signal (D) represents the status signal coupled back to the CPU via port 24. It will be appreciated that, as illustrated in FIGS. 5A and 5B, the operation of trigger circuits of the types described accomplishes a desired filtering effect at the cost of a short delay while the circuit waits to determine whether a rising edge, for example, does or does not represent a transitory change such as produced by a clock pulse or spurious pulse. As shown in FIG. 5B, while curve (C) quickly responds to the falling edge of spurious pulse (B), the response of signal (C) to the rising edge of pulse (B) is delayed while the filtering effect is implemented. That is to say, there is no need in the FIG. 5B type trigger unit to wait for a response time delay after the falling edge. Thus, the reaction time as shown between the falling edge of trigger signal (B) in FIG. 4 and the reset signal (C) of FIG. 4 is avoided and the FIG. 6 system is enabled to operate at an overall faster rate of speech segment selection.

While there have been described the currently preferred embodiments of the invention, those skilled in the art will recognize that other and further modifications and variations may be made without departing from the invention and it is intended to claim all modifications and variations as fall with the scope of the invention.

What is claimed is:

1. A serial interface speech synthesizer system, responsive to a control signal serially encoded to include information corresponding to an address location of a selected speech segment signal, said control signal comprising a series of pulses corresponding to a numerical representation of said selected speech segment signal, said system comprising:

a signal converter for converting said control signal, coupled via an input port having only a single signal path, to a corresponding multi-bit binary selection signal representing the amount of said pulses in said control signal;

a synthesis unit, responsive to a trigger signal and coupled to said signal converter, for providing the selected one of a variety of said speech segment signals based on said binary selection signal coupled via an address bus including several parallel signal paths;

a trigger signal generator, coupled to said synthesis unit and responsive to said control signal coupled via said input port, for processing said control signal to reduce undesired triggering effects in order to provide said trigger signal; and an output port, coupled to said synthesis unit, for coupling said speech segment signal from said synthesis unit to a utilization device.

2. A serial interface speech synthesizer system as in claim 1, wherein said trigger signal generator also provides a reset signal to said signal converter to reset said signal converter when said trigger signal generator detects a pulse greater than a predetermined threshold level representing the end of said control signal.

3. The system of claim 1 wherein said signal converter includes a counter.

4. A serial interface speech synthesizer system, comprising:

a counter, arranged to be reset by a reset signal, for providing a multi-bit binary selection signal in response to a control signal received via an input port having only a single first signal path;

a synthesis unit, responsive to a trigger signal and coupled to said counter, for providing a selected one of a plurality of speech segment signals based on said binary selection signal coupled via an address bus including several parallel signal paths, and for providing a status signal indicative of the operating state of said synthesis unit;

a trigger signal generator, coupled to said synthesis unit and responsive to said control signal received via said input port, for processing said control signal to reduce undesired triggering effects in order to provide said trigger signal and to provide said reset signal when said trigger signal generator detects a pulse greater than a predetermined threshold level representing the end of said control signal;

a control unit, coupled to said counter and said trigger signal generator and responsive to said status signal coupled via a second signal path, for providing said control signal to said input port in a form serially encoded to include said control signal comprising a series of pulses corresponding to a numerical address representation of a selected speech segment signal; and an output port, coupled to said synthesis unit, for coupling said selected speech segment signal from said synthesis unit to a utilization device;

whereby, said control unit requires only said first and second signal paths for control of said synthesizer system.

5. A serial interface speech synthesizer system as in claim 4, wherein said synthesis unit is arranged to provide any one of 256 speech segment signals, said address bus includes at least eight signal paths, and said output port is arranged to couple said selected speech segment signal to a utilization device in the form of a speaker effective to provide a sound output wherein different speech segment signals are combined in series to simulate spoken words.

* * * * *